US006784390B2

(12) United States Patent
Chu

(10) Patent No.: US 6,784,390 B2
(45) Date of Patent: Aug. 31, 2004

(54) ELECTRICAL SWITCH

(75) Inventor: Raymond Wai Hang Chu, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 0 days.

(21) Appl. No.: 10/231,021

(22) Filed: Aug. 30, 2002

(65) Prior Publication Data

US 2004/0040827 A1 Mar. 4, 2004

(51) Int. Cl.[7] ..... H01H 13/30

(52) U.S. Cl. ..... 200/522; 200/534; 200/243; 200/435

(58) Field of Search ..... 200/522, 243, 200/241, 240, DIG. 42, 534, 250, 434, 435, 447

(56) References Cited

U.S. PATENT DOCUMENTS 3,777,092 A * 12/1973 Yeske ..... 200/522
4,379,214 A * 4/1983 Matthews ..... 200/522
4,618,747 A * 10/1986 Schaffeler ..... 200/DIG. 42
5,360,954 A * 11/1994 Bruggeman et al. ..... 200/447
6,483,049 B1 * 11/2002 Mohtasham ..... 200/243

FOREIGN PATENT DOCUMENTS

EP A1 0 011 413 * 5/1980
GB 2 074 385 A * 4/1981

* cited by examiner

*Primary Examiner*—Renee Luebke
(74) *Attorney, Agent, or Firm*—Leydig, Voit & Mayer, Ltd.

(57) ABSTRACT

An electrical switch having a casing, at least two fixed contacts and a corresponding moving contact. The moving contact has two parts contactable with the fixed contacts respectively thereby closing the switch. An operating member is supported for movement for moving the moving contact to close the switch. A spring acts upon the moving contact such that its two parts are inclined at an acute angle relative to the fixed contacts, with at least one of the parts being spaced apart from the corresponding fixed contact while the switch is open. The moving contact is movable such that said at least one or both of its parts comes or come into contact with the corresponding fixed contact or contacts against the action of the spring. In particular, the moving contact is movable against the action of the spring to have its two parts turning through said acute angle until both parts are in contact with the corresponding fixed contacts.

2 Claims, 3 Drawing Sheets

ELECTRICAL SWITCH

The present invention relates to a switch for controlling the operation of an electrical appliance.

BACKGROUND OF THE INVENTION

The electrical switch of a known type includes a casing, two fixed contacts and a moving contact which has opposite ends for short-circuiting the fixed contacts to close the switch upon movement by an operating member through the action of a spring. In case that the spring malfunctions and in particular when it is broken, the moving contact may stay in contact with the fixed contacts. This situation is undesirable and not safe.

The invention seeks to mitigate or at least alleviate such a problem by providing an improved electrical switch of this type in general.

SUMMARY OF THE INVENTION

According to the invention, there is provided an electrical switch comprising a casing, and at least two fixed contacts and a corresponding moving contact in the casing. The moving contact has two parts contactable with the fixed contacts respectively thereby closing the switch. An operating member is supported for movement relative to the casing for moving the moving contact to close the switch. Resilient means acts upon the moving contact such that its two parts are inclined at an acute angle relative to the fixed contacts, with at least one of the parts being spaced apart from the corresponding fixed contact while the switch is open. The moving contact is movable such that said at least one or both of its parts comes or come into contact with the corresponding fixed contact or contacts against the action of the resilient means.

Preferably, the moving contact has one side facing the fixed contacts and an opposite side on which the resilient means is provided.

More preferably, the resilient means comprises a compression coil spring.

In a preferred embodiment, the electrical switch includes a carrier movable by the operating member and carrying the moving contact and the resilient means for simultaneous movement. The carrier includes an inclined portion lying against which the moving contact is acted upon by the resilient means to incline at said acute angle relative to the fixed contacts.

More preferably, the fixed contacts are spaced apart by a gap, and the carrier is supported for movement in the gap such that its inclined portion is movable at least partially beyond the fixed contacts to allow the two parts of the moving contact to contact with the corresponding fixed contacts.

More preferably, the carrier includes a recess having opposite, first and second ends and locating the moving contact and the resilient means. The moving contact lies against the first end that being the inclined portion and the resilient means co-acts between the moving contact and the second end.

In a specific construction, the electrical switch includes two pairs of said fixed contacts and two corresponding said moving contacts movable simultaneously by the operating member for operation.

In general, the electrical switch may include a sliding carrier carrying the moving contact and the resilient means for simultaneous movement, a slider movable by the operating member for in turn moving the carrier, and an over-centre pivotal spring co-acting between the carrier and the slider such that the carrier and the slider are slidable in opposite directions.

Slightly more specifically, the operating member is supported for pivotal movement and is connected to the slider by means of a link for moving the slider. The electrical switch may be a normally-open switch, in that the operating member is resiliently biassed by a spring towards an inoperative position.

In particular, the electrical switch may be a trigger switch for use in an electric power tool.

According to a slightly different aspect of the invention, there is provided an electrical switch comprising a casing, and at least two fixed contacts and a corresponding moving contact in the casing. The moving contact has two parts contactable with the fixed contacts respectively thereby closing the switch. An operating member is supported for movement relative to the casing for moving the moving contact to close the switch. The moving contact is supported with its two parts inclined at an acute angle relative to the fixed contacts under the action of resilient means such that at least one of its parts is spaced apart from the corresponding fixed contact whale the switch is open. The moving contact is movable against the action of the resilient means to have its two parts turning through said acute angle until both parts are in contact with the corresponding fixed contacts.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
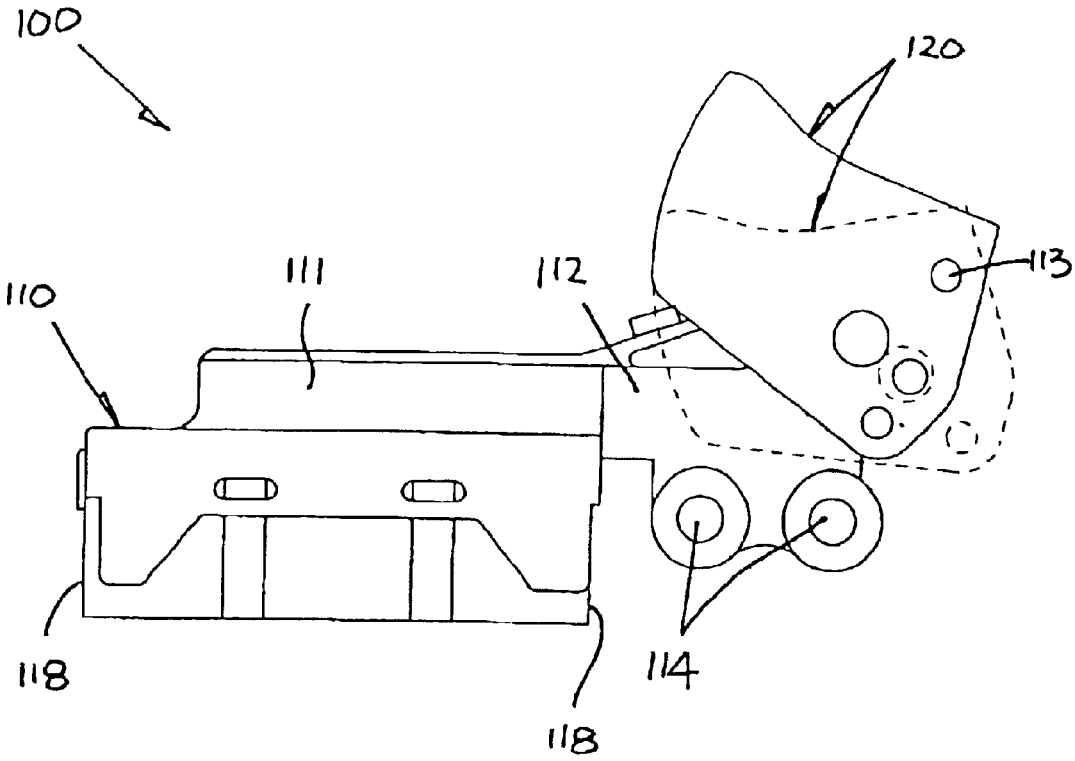
FIG. 1 is a side view of an embodiment of an electrical switch in accordance with the invention, said switch having a pair of moving contacts and associated fixed contacts and an operating member for operating the moving contacts.
Figure 2:
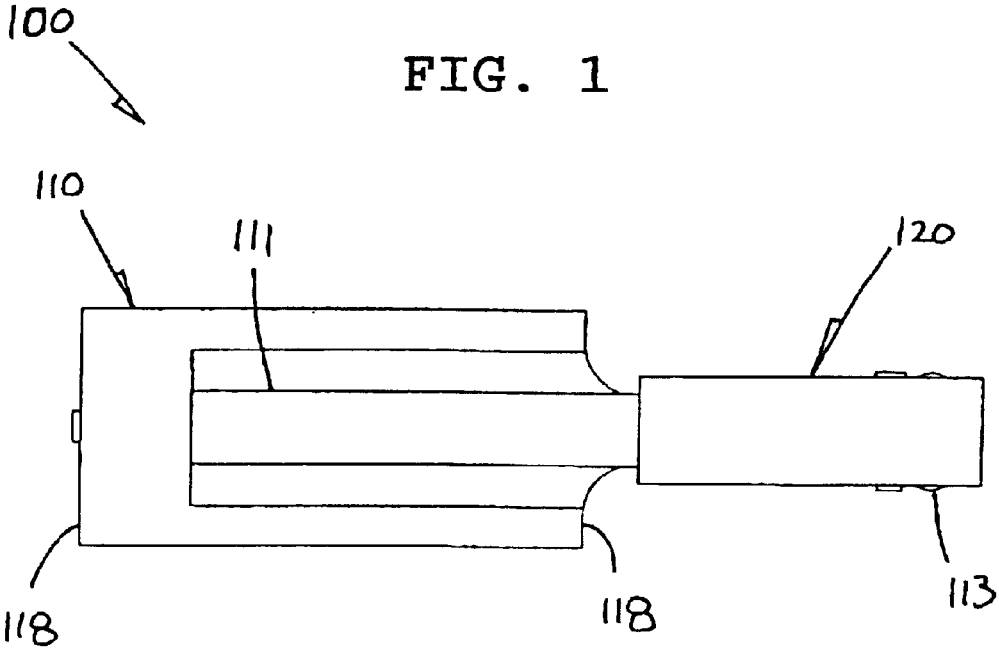
FIG. 2 is a top plan view of the switch of FIG. 1.
Figure 5:
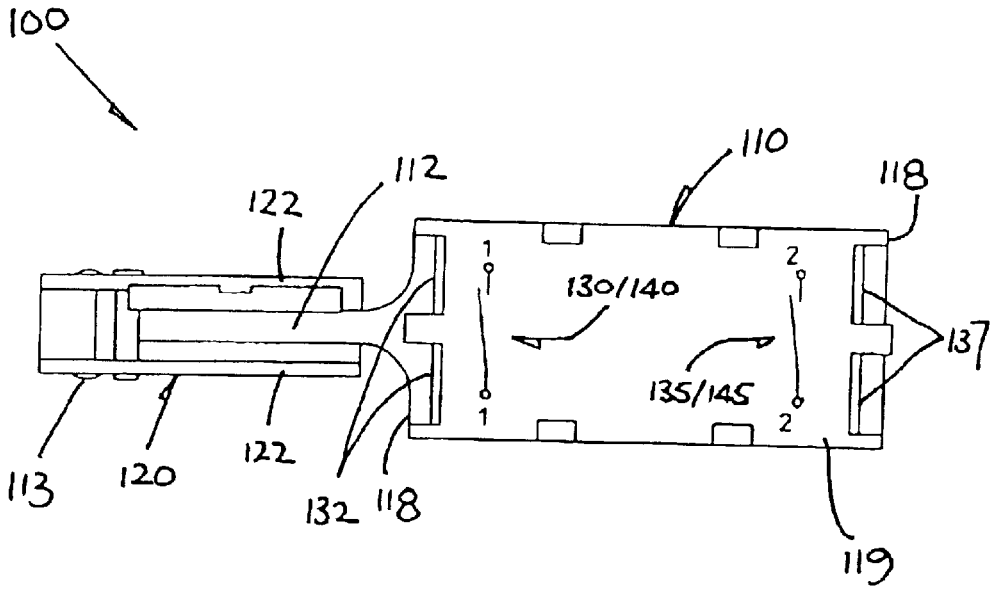
FIG. 5 is a bottom plan view of the switch of FIG. 4.
Figure 3:
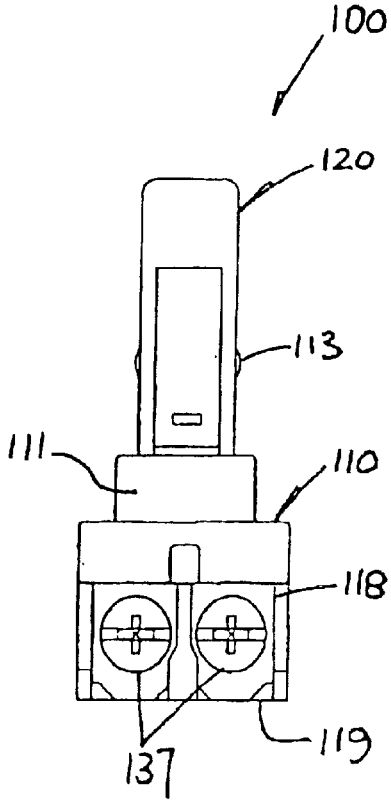
FIG. 3 is an end view of the switch of FIG. 1.
Figure 6:
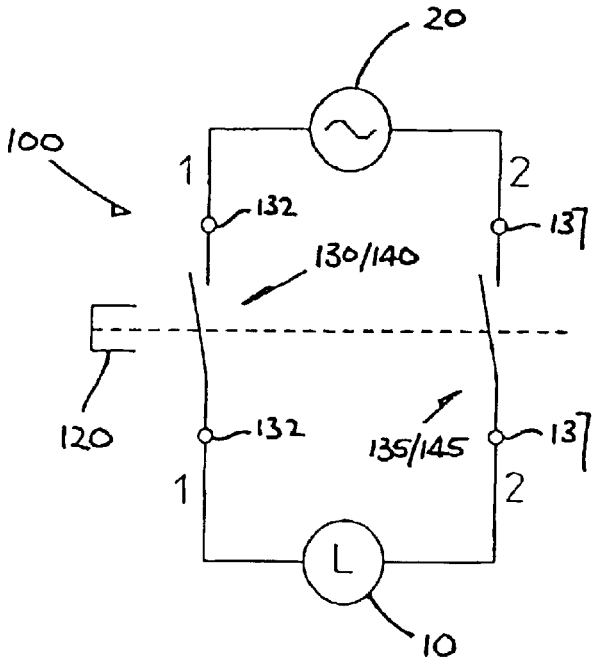
FIG. 6 is a schematic circuit diagram showing the switch of FIG. 1 connected to a load and a power source.

Referring to the drawings, there is shown an electrical switch 100 embodying the invention, which switch 100 has a rectangular casing 110 and an operating trigger 120. The casing 110 has an inverted U-shaped cross-section that is closed by a bottom plate 119 such that opposite, front and rear ends 118 of the casing 110 are open. The casing 110 includes a top wall, on which a elongate integral support 111 lies that projects beyond the front casing end 118. Two holes 114 are integrally formed at a free end 112 of the support 111 for mounting the overall switch 100 by means of screws for example.

The switch 100 is a normally-open switch and is designed to be used for trigger control in electric power tools, and in particular but not exclusively heavy current, for example 25A, power tools such as a circular saw 10.

The support end 112 is crooked upwards to form a hinge 113 that connects the trigger 120 for pivotal movement. The trigger 120 is of an inverted U-shaped cross-section embracing the support end 112 and hinge 113. The trigger 120 has a top wall 121 for depression by a user and includes a pair of opposed side walls 122 connected at its outer top corner to the hinge 113. An internal compression coil spring 123 co-acts between the top wall 121 and the support end 112 for resiliently biassing the trigger 120 to pivot upwardly into an inoperating position (solid line). Upon depression, the trigger 120 pivots downwardly into an operating position (dotted line) against the action of the spring 123. The trigger 120 will return to the inoperating position upon release.

The trigger side walls 122 are also hinged, at its outer bottom corner, to a linkage rod 124 that extends internally along the support 111 back to above the switch casing 110. The support 111 houses, within its rear end, a slider 115 that is articulated with the rear end of the rod 124 for movement thereby in opposite directions upon depression and release of the trigger 120. The slider 115 is in engagement with a compression coil spring 116 underneath it.

Housed within the casing 110, the switch 100 includes two, front and rear pairs of fixed contacts 130 and 135 and two corresponding pairs of moving contacts 140 and 145 arranged to make and break electrical connection between the fixed contacts 130 and 135 of the corresponding pairs. Each pair of the moving contacts 140/145 is mounted on opposite ends of a corresponding transversely-extending contact bar 141/146, together acting effectively as a single moving contact. Each pair of the fixed contacts 130/135 and the associated moving contact(s) 140/145 constitute an individual switch, and both switches are simultaneously operable by the trigger 120.

The front fixed contacts 130 are mounted on the inner ends of respective identical S-shaped contact strips 131, whose outer ends are positioned just within the front casing end 1 and act as a pair of terminals 132. The rear fixed contacts 135 are mounted on the inner ends of respective identical U-shaped contact strips 136, whose outer ends are positioned just within the rear casing end 118 and act as another pair of terminals 137. The contact strips 131/136 of each pair are laterally aligned and,run in parallel on opposite, left and right sides within a corresponding casing end 118, being spaced apart to form a gap G therebetween that extends along the central axis of the casing 110. In particular, the fixed contacts 130/135 of each pair lie on a plane perpendicular to the central axis.

Also housed within the casing 110, the switch 100 includes a carrier 150 which is supported for sliding movement in opposite directions within the gap G and therealong. The carrier 150 is positioned directly below the slider 115 and is in engagement with the coil spring 116, with the spring 116 co-acting between the two sliders 115 and 150. The spring 116 acts an over-centre pivot that pivots in opposite directions for expansion past a central position at which it is compressed. Thus, upon movement of the slider 115 in one or the other direction by the rod 124, the carrier 150 is slid rapidly in the opposite direction by the spring 116 as a result of its re-expansion.

Figure 4:
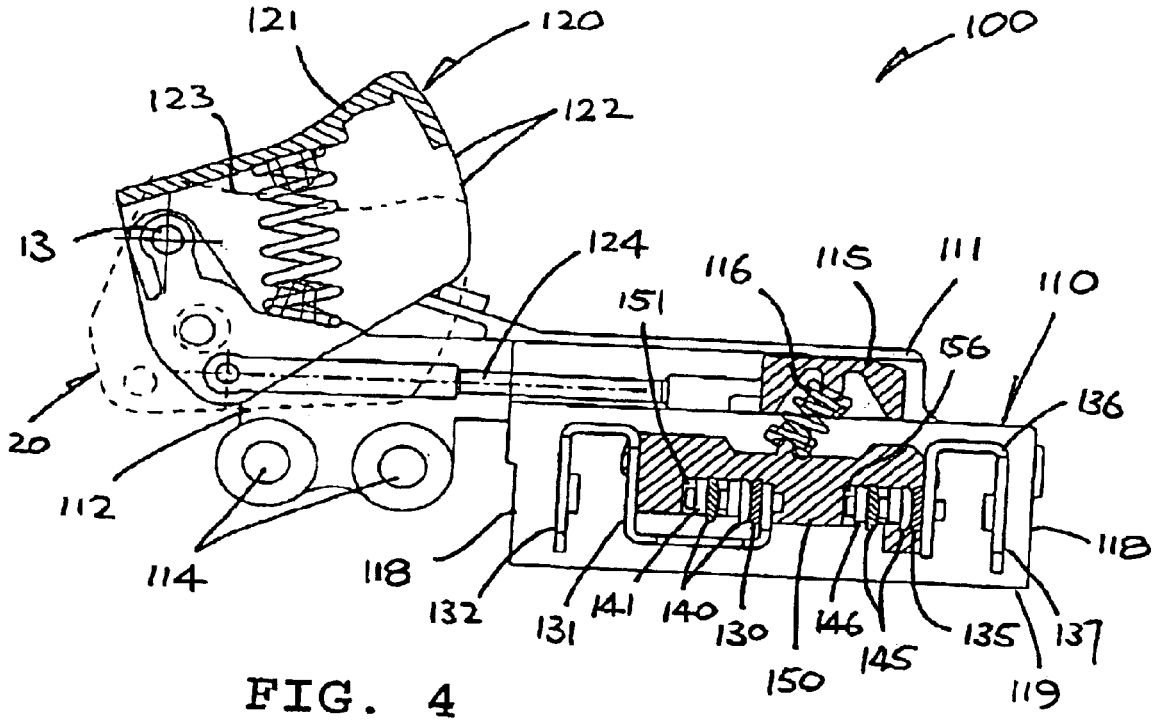
FIG. 4 is a cross-sectional side view of the switch of FIG. 1, showing its internal construction.
Figure 4A:
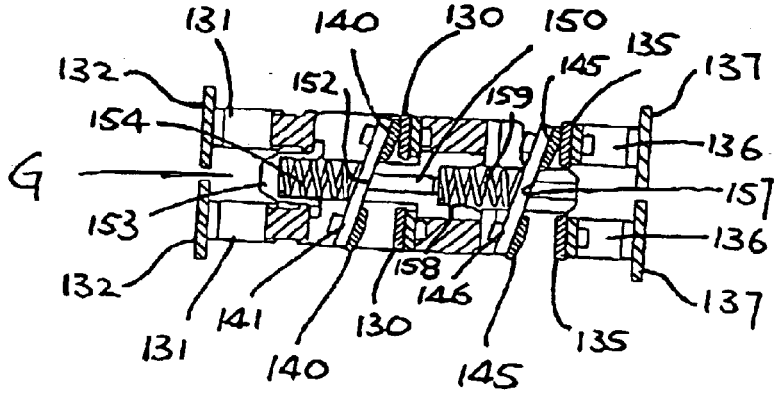
FIG. 4A is a bottom plan view of part of the switch of FIG. 4, showing its moving and fixed contacts.

The carrier 150 includes, on its lower side, a pair of front and rear recesses 151 and 156 carrying the moving contact bars 141 and 146 respectively for simultaneously movement. As shown in FIG. 4A, each recess 151/156 has a rear end wall 152/157 that is inclined laterally at an acute angle of 10° to 30° and includes a front end seat 153/158 that locates horizontally a respective compression coil spring 154/159. The spring 154/159 points at the inclined end wall 152/157, between which the corresponding contact bar 141/146 is compressed. Thus, the moving contacts 140/145 face the corresponding fixed contacts 130/135 on one side and are acted upon by the spring 154/159 on the opposite side.

Each coil spring 154/159 urges the contact bar 141/146 to lie flat against the corresponding inclined end wall 152/157, such that the contact bar 141/146 or the moving contacts 140/145 are normally inclined at the same angle relative to the corresponding fixed contacts 130/135. This condition is shown in FIG. 4A, which corresponds to the inoperating position of the trigger 120 (solid line) and in which the moving contacts 140/145 are inclined and thus spaced apart (on at least one side as shown) from the fixed contacts 130/135.

Upon depression of the trigger 120 (dotted line), the carrier 150 is slid via the rod 124, the slider 115 and the spring 116. In response, the carrier 150 moves the moving contacts 140/145 flat against the corresponding fixed contacts 130/135 counteracting the springs 154/159, thereby closing the overall switch 100. The carrier 150 slides to move its inclined walls 152/157 beyond, or at least partially beyond, the corresponding fixed contacts 130/135, thereby allowing the moving contacts 140/145 to engage the fixed contacts 130/135.

In particular, the moving contacts 140/145 will turn through the aforesaid acute angle about the moving contacts 140/145 on one side that are in, or have earlier come into, engagement with the respective fixed contacts 130/135 until the moving contacts 140/145 on the other side hit the corresponding fixed contacts 130/135.

Upon release of the trigger 120, the switch 100 returns automatically to the normally-open condition.

The switch 100 is to be connected, using its terminals 132 and 137, between the power tool 10 and an AC power source 20.

In the construction of this particular switch 100 as described, the operating trigger 120 acts through the springs 123 and 116. The over-centre pivot spring 116 is especially prone to breaking through repeated operations. The moving contacts 140 and 145 are inclined at an acute angle, while lying against the inclined portions 152 and 157, relative to the fixed contacts 130 and 135 under the action of the springs 154 and 159. Should the pivot spring 116 break, the contact springs 154 and 159 in conjunction with the inclined portions 152 and 157 will instantly cause the moving contacts 140 and 145 to turn away from the fixed contacts 130 and 135, whereby the switch 100 is opened for safety.

It is understood that the springs 154 and 159 may take any other forms of resilient means, such as a spring lever or an elbow spring.

The invention has been given by way of example only, and various other modifications of and/or alterations to the described embodiment may be made by persons skilled in the art without departing from the scope of the invention as specified in the appended claims.

What is claimed is:

1. An electrical switch comprising a casing, at least two fixed contacts spaced apart by a gap, and a corresponding moving contact in the casing, the moving contact having two parts contactable with the fixed contacts respectively thereby closing the switch, an operating member supported for movement relative to the casing for moving the moving contact to close the switch, a carrier movable by the operating member and carrying the moving contact and a resilient means for simultaneous movement, the carrier including an inclined portion for contacting the moving contact, the moving contact being acted upon by the resilient means such that the two parts of the moving contact incline at an acute angle relative to the fixed contacts, with at least one of the parts being spaced apart from the corresponding fixed contact while the switch is open, the moving contact being movable such that one of its parts comes into contact with the corresponding fixed contact or contacts against the action of the resilient means before the other part of the moving contact comes into contact with the corresponding fixed contact or contacts against the action of the resilient means, wherein the carrier is supported for movement in the gap such that its inclined portion is movable at least partially beyond the fixed contacts to allow the two parts of the moving contact to contact with the corresponding fixed contacts.

2. An electrical switch comprising a casing, at least two fixed contacts and a corresponding moving contact in the casing, the moving contact having two parts contactable with the fixed contacts respectively thereby closing the switch, an operating member supported for movement relative to the casing for moving the moving contact to close the switch, a carrier movable by the operating member and carrying the moving contact and a resilient means for simultaneous movement, the carrier including an inclined portion for contacting the moving contact wherein the carrier includes a recess having opposite, first and second ends and locating the moving contact and the resilient means, the moving contact lying against the first end that end being the inclined portion and the resilient means co-acting between the moving contact and the second end, the moving contact being acted upon by the resilient means such that the two parts of the moving contact incline at an acute angle relative to the fixed contacts, with at least one of the parts being spaced apart from the corresponding fixed contact while the switch is open, the moving contact being movable such that one of its parts comes into contact with the corresponding fixed contact or contacts against the action of the resilient means before the other part of the moving contact comes into contact with the corresponding fixed contact or contacts against the action of the resilient means.

* * * * *